US007142793B1

(12) United States Patent
Potter et al.

(10) Patent No.: US 7,142,793 B1
(45) Date of Patent: Nov. 28, 2006

(54) XEROGRAPHIC FUSING APPARATUS WITH A TEMPERATURE-SENSITIVE POSITIONING MECHANISM FOR A HEATING ELEMENT

(75) Inventors: Scott M. Potter, Welwyn Garden City (GB); John Poxon, Stevenage (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/231,510

(22) Filed: Sep. 21, 2005

(51) Int. Cl.
*G03G 15/20* (2006.01)

(52) U.S. Cl. ..... 399/69; 399/33; 399/334

(58) Field of Classification Search ..... 399/69
See application file for complete search history.

(56) References Cited

U.S. PATENT DOCUMENTS 4,639,122 A * 1/1987 Pease ..... 399/335
6,353,718 B1 3/2002 Roxon et al.
6,901,226 B1 5/2005 Claassen
2004/0165911 A1* 8/2004 Suzuki ..... 399/122
2005/0111863 A1* 5/2005 Ogashima ..... 399/69

FOREIGN PATENT DOCUMENTS

JP 01285973 A * 11/1989

* cited by examiner

*Primary Examiner*—David M. Gray
*Assistant Examiner*—Bryan Ready
(74) *Attorney, Agent, or Firm*—R. Hutter

(57) ABSTRACT

An apparatus for fusing print sheets, such as in xerographic printing, comprises a heating element, and a temperature-sensitive mounting for the heating element. The mounting changes a position of the heating element over the course of use of the apparatus, thereby enabling a more efficient use of the heating element and emitted heat within the fusing apparatus.

5 Claims, 7 Drawing Sheets

XEROGRAPHIC FUSING APPARATUS WITH A TEMPERATURE-SENSITIVE POSITIONING MECHANISM FOR A HEATING ELEMENT

TECHNICAL FIELD

The present invention relates to a fusing apparatus, as used in electrostatographic printing, such as xerographic printing or copying, and methods of operating thereof.

BACKGROUND

In electrostatographic printing, commonly known as xerographic or printing or copying, an important process step is known as "fusing". In the fusing step of the xerographic process, dry marking material, such as toner, which has been placed in imagewise fashion on an imaging substrate, such as a sheet of paper, is subjected to heat and/or pressure in order to melt or otherwise fuse the toner permanently on the substrate. In this way, durable, non-smudging images are rendered on the substrates.

Currently, the most common design of a fusing apparatus as used in commercial printers includes two rolls, typically called a fuser roll and a pressure roll, forming a nip therebetween for the passage of the substrate therethrough. Typically, the fuser roll further includes, disposed on the interior thereof, one or more heating elements, which radiate heat in response to a current being passed therethrough. The heat from the heating elements passes through the surface of the fuser roll, which in turn contacts the side of the substrate having the image to be fused, so that a combination of heat and pressure successfully fuses the image.

One practical challenge in the design of a fuser is maintenance of a consistent temperature along the length of the fuser roll, avoiding localized areas of too-low or too-high surface temperatures.

U.S. Pat. No. 6,353,718 shows an example of a design of a multi-lamp fuser, while U.S. Pat. No. 6,901,226 describes a control method for a multi-lamp fuser.

SUMMARY

According to one aspect, there is provided an apparatus for fusing print sheets, comprising a heating element, and a temperature-sensitive mounting for the heating element. The mounting changes a position of the heating element.

According to another aspect, there is provided an apparatus for fusing print sheets moving in a process direction, comprising a heating element slidable in a direction substantially perpendicular to the process direction.

According to another aspect, there is provided an apparatus for fusing print sheets moving in a process direction, comprising a heating element and a temperature sensor useful in controlling the heating element. A temperature-sensitive mounting for the temperature sensor changes a position of the temperature sensor in a direction substantially perpendicular to the process direction.

DETAILED DESCRIPTION

Figure 1:
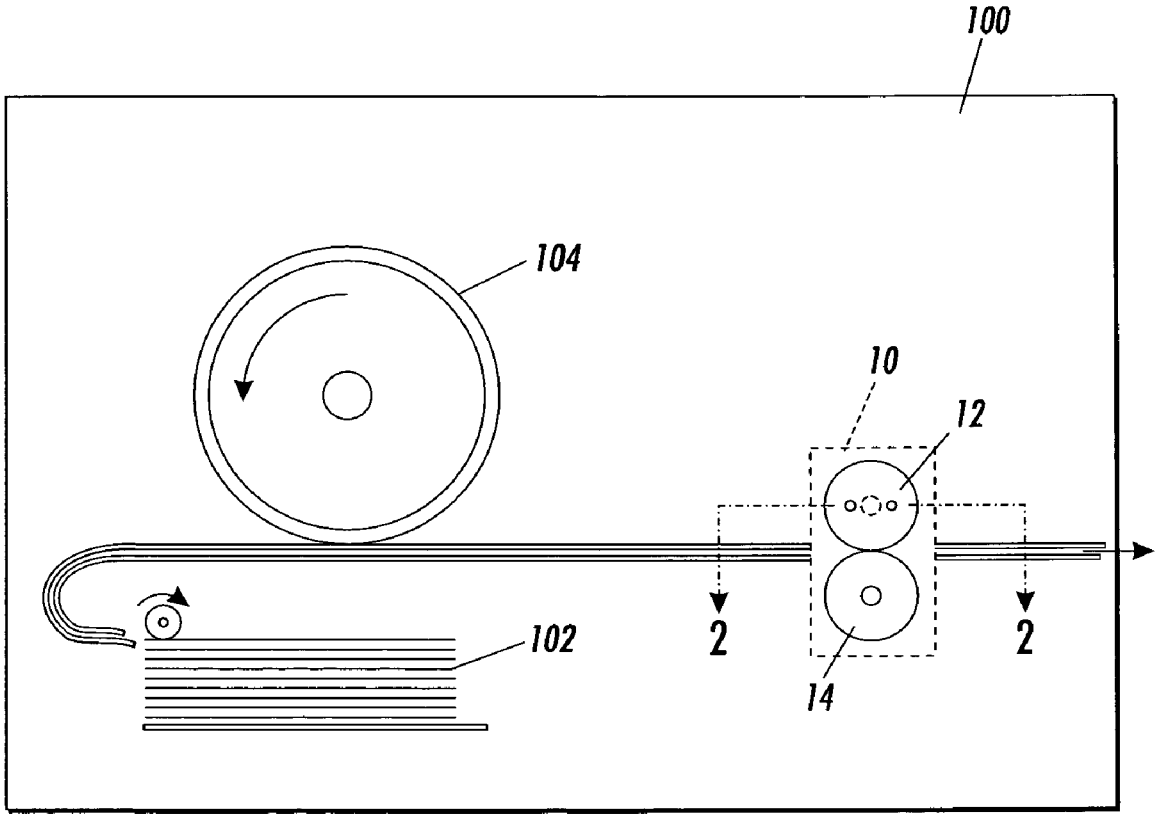
FIG. 1 PRIOR ART
FIG. 1 is a simplified elevational view showing the essential portions of an electrostatographic printer, as known in the prior art.

FIG. 1 is a simplified elevational view showing the essential portions of an electrostatographic printer, such as a xerographic printer or copier, relevant to the present invention. A printing apparatus 100, which can be in the form of a digital or analog copier, "laser printer", ionographic printer, or other device, includes mechanisms which draw substrates, such as sheets of paper, from a stack 102 and cause each sheet to obtain a toner image from the surface of a charge receptor 104. Once a particular sheet obtains marking material from charge receptor 104, the sheet is caused to pass through a fusing apparatus such as generally indicated as 10. Depending on a particular design of an apparatus, fusing apparatus 10 may be in the form of a fuser module that can be removed, in modular fashion, from the larger apparatus 100. (Although an electrostatographic printer is shown in FIG. 1, a fusing apparatus such as 10 can also be used with an ink-jet printing apparatus as well.)

A typical design of a fusing apparatus 10 includes a fuser roll 12 and a pressure roll 14. Fuser roll 12 and pressure roll 14 cooperate to exert pressure against each other across a nip formed therebetween. When a sheet passes through the nip, the pressure of the fuser roll against the pressure roll contributes to the fusing of the image on a sheet. Fuser roll 12 further includes means for heating the surface of the roll, so that heat can be supplied to the sheet in addition to the pressure, further enhancing the fusing process. Typically, the fuser roll 12, having the heating means associated therewith, is the roll which contacts the side of the sheet having the image desired to be fused.

Generally, the most common means for generating the desired heat within the fuser roll 12 is one or more heating elements within the interior of fuser roll 12, so that heat generated by the heating elements will cause the outer surface of fuser roll 12 to reach a desired temperature. Various configurations for heating elements have been discussed above with regard to the prior art. Basically, the heating elements can comprise any material that outputs a certain amount of heat in response to the application of electrical power thereto: such heat-generating materials are well known in the art.

Figure 2:
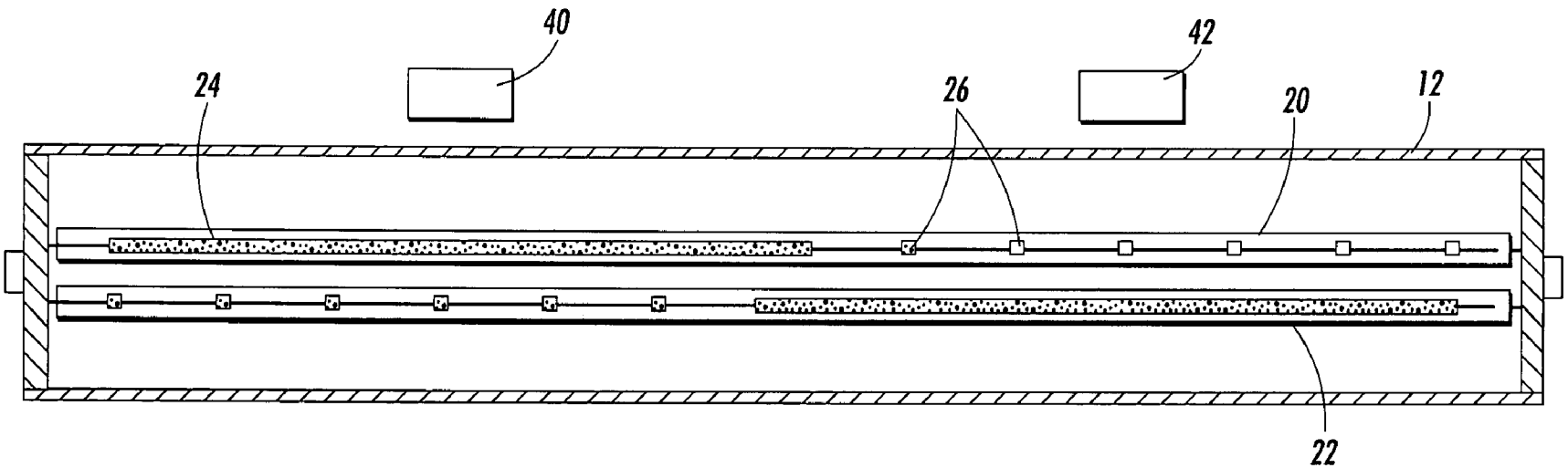
FIG. 2 PRIOR ART
FIG. 2 is a sectional view of the fuser roll 12 as viewed through the line marked 2—2 in FIG. 1, as known in the prior art.

FIG. 2 is a sectional view of a typical prior-art multiple lamp fuser roll 12 as viewed through the line marked 2—2 in FIG. 1. As can be seen in the Figure, there is disposed within the interior of fuser roll 12 two "lamps," meaning structures which incorporate heating elements, indicated as 20 and 22. The lamps 20 and 22 are each disposed along the axial length of the fuser roll 12, and as such are disposed to be largely perpendicular to a process direction of sheets passing through the nip of the fusing apparatus 10.

As can be seen in FIG. 2, each lamp, such as 20, includes a specific configuration of heat-producing material, in this particular case, a relatively long major portion of heat-producing material 24, along with a number of smaller portions of heat-producing material, indicated as 26, all of which are connected in series. It will be noted that, within each lamp such as 20 or 22, major portion 24 is disposed toward one particular end of the fuser roll 12, while the relatively smaller portions 26 are disposed toward the opposite end of the fuser roll 12. Such an arrangement can provide each lamp 20, 22 with a desirable general "profile" of heat output along its length (e.g., a relatively hot end and cool end), which can be exploited, for instance, when fusing sheets of various sizes. In a practical embodiment, the heat-producing material substantially comprises tungsten, while the overall structure of the lamp is borosilicate glass: these materials are fairly common in the fuser-lamp context.

One practical challenge in the design of a fuser is maintenance of a consistent temperature along the length of the fuser roll, avoiding localized areas of too-low or too-high surface temperatures ("hot spots"). If thermistors 40, 42 or other thermal sensors as shown in FIG. 1 measure temperature at relatively small sub-areas of the outer surface of the roll 12, it is difficult to detect inconsistencies in temperature along the length of the roll, which can result in print quality defects.

One approach to address the temperature consistency problem is to permit or cause a small change in position of one or more lamps such as 20, 22 (or, more broadly, heating elements) along the axial direction of the roll such as 12. If the lamp moves, any irregularity in the profile of heat output along the length of the lamp will be largely "evened out" along the length of movement of the lamp. Also, providing one or more moveable lamps within a fusing apparatus enables the apparatus to take "corrective action," such as by changing the position of the lamp, such as when a particular area within the fusing apparatus becomes too hot or too cool.

In one possible embodiment, a lamp such as 20 can be moved within (or otherwise relative to) the outer surface of a roll 12 by effectively mounting the lamp in slidable fashion within roll 12, within in association with a temperature-sensitive mechanism, so that general changes in temperature associated with the fusing apparatus 12 will cause changes in the position of the lamp. In some embodiments, the position of the heating elements within the lamp such as 20 is changed along a direction substantially perpendicular to the process direction through which sheets pass through fusing apparatus 10.

Figure 3:
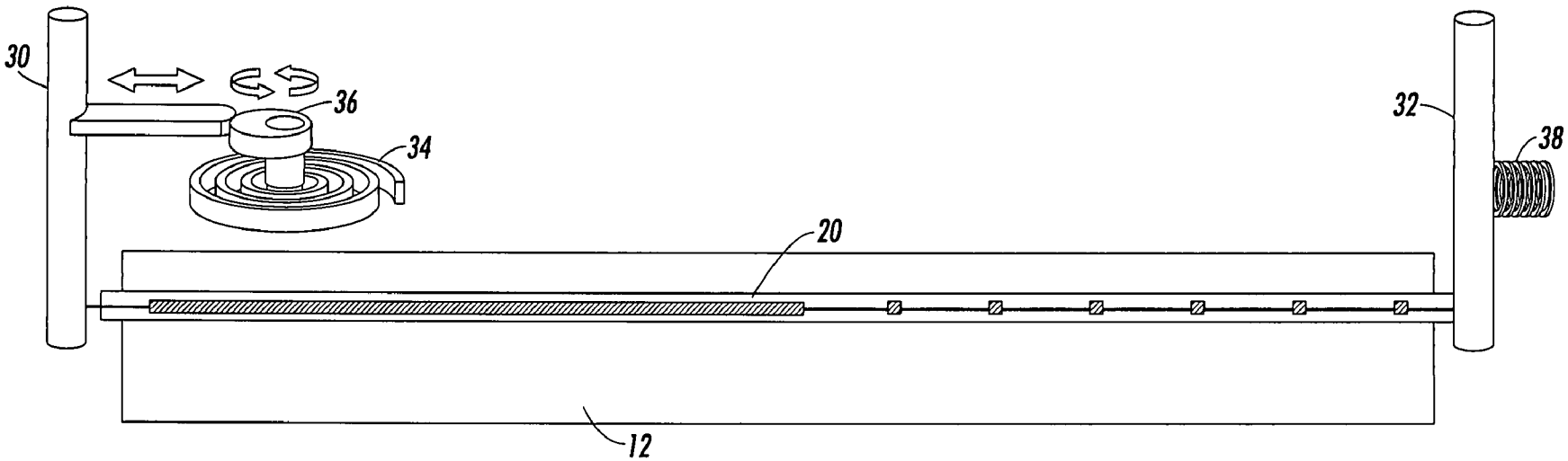
FIG. 3 is a simplified view of a fuser roll and associated mounting, in isolation.

FIG. 3 is a simplified view of a fuser roll and associated mounting, in isolation. The lamp 20 disposed within roll 12 is slidably held in place by brackets 30, 32. Bracket 30 is associated with a bimetallic coil 34 and cam 36 (which are in turn suitably mounted relative to the rest of the printing apparatus, by means not shown). The bimetallic coil 34 changes its configuration with changing temperatures, and thus rotate cam 36, which, as shown, causes bracket 30 to move the lamp 20 small amounts relative to the outer surface of roll 12 as the general temperature changes. A return spring 38 can further be provided on the other end of the lamp 20.

With an arrangement such as shown in FIG. 3, when the fusing apparatus 10 warms up from an off state or energy-saving state, the lamp 20 moves an appreciable distance along the length of roll 12 as the fusing apparatus 10 undergoes a change from room temperature to operating temperature. Also, in practical operation, fusing of successive sheets in a short period of time will cause a momentary decrease in the general temperature of the fusing apparatus 10: the decrease in temperature will also cause a change in position of the lamp 20. The changes in position of the lamp 20 during warm-up and operation allow the heat-output profile of the lamp 20 to more uniformly heat the surface of the roll 12 as the general temperature of the fusing apparatus 10 changes over time.

Figure 4:
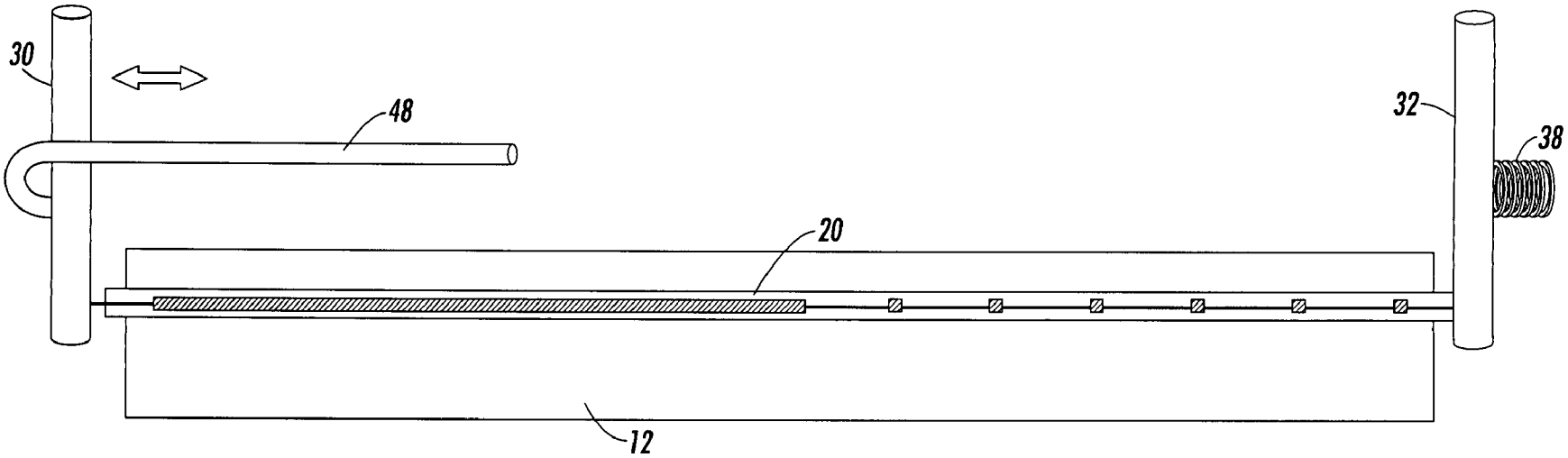
FIG. 4 is a simplified view of a fuser roll and mounting, according to another embodiment.

FIG. 4 is a simplified view of a fuser roll and mounting, in isolation, according to another embodiment. An expandable container 48 containing an appreciably expandable liquid or gas is mounted relative to bracket 30, and performs a function analogous to that of the bimetallic strip discussed above.

Figure 5:
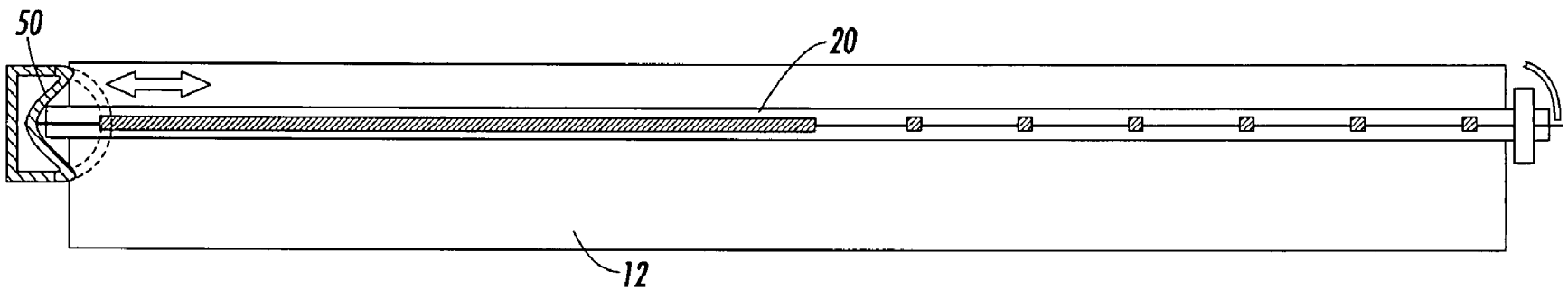
FIG. 5 is a partial simplified view of a fuser roll and mounting, according to another embodiment.

FIG. 5 is a partial simplified view of a fuser roll and mounting, in isolation, according to another embodiment. Here, a dome 50 having temperature-sensitive properties is used in the mounting of lamp 20. Such a dome can be designed to have an effectively "two state" behavior, causing the lamp 20 to be disposed in one of two positions depending on general temperature.

Figure 6:
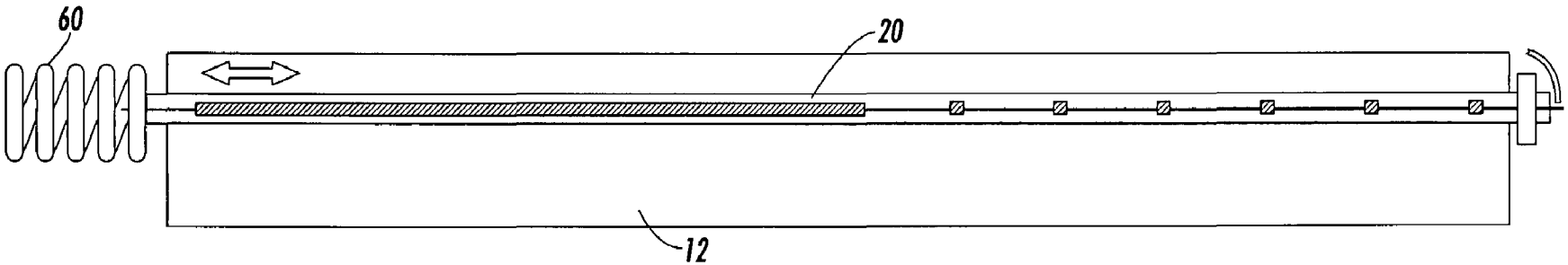
FIG. 6 is a partial simplified view of a fuser roll and mounting, according to another embodiment.

FIG. 6 is a partial simplified view of a fuser roll and mounting, in isolation, according to another embodiment. A bimetallic cylindrical coil spring 60 having temperature-sensitive properties is disposed to be substantially coaxial with the lamp 20.

Figure 7:
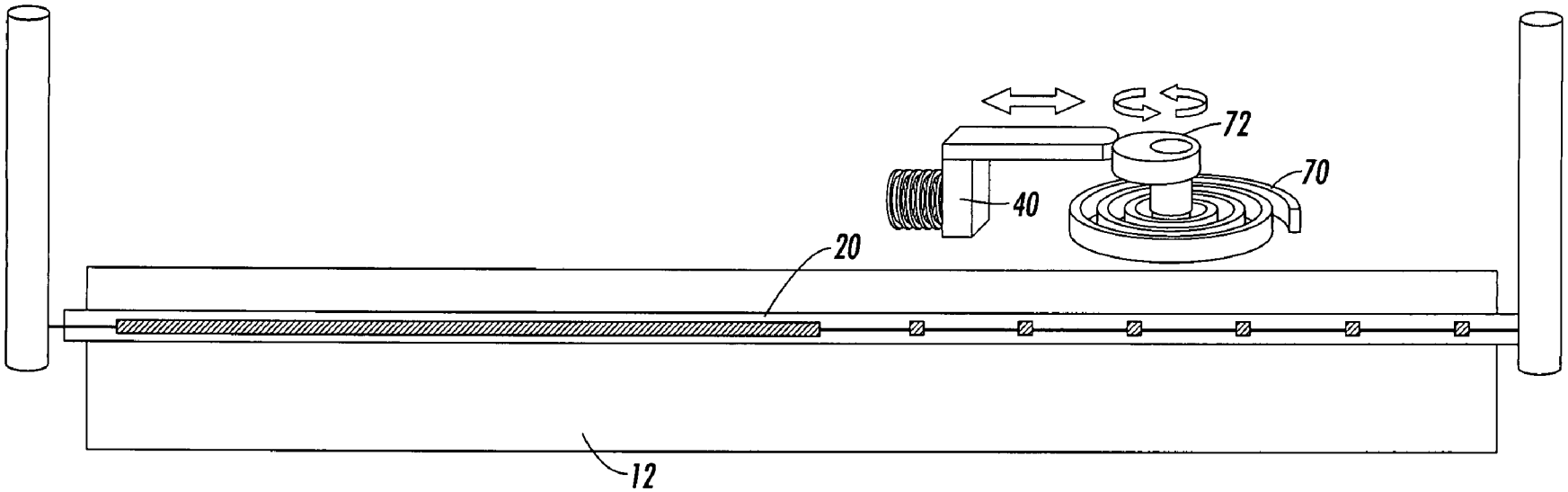
FIG. 7 is a simplified diagram of a temperature-sensitive mounting of a thermal sensor.

Another possible approach to obtaining consistency of temperature along a fuser roll 20 can include changing the position, relative to the surface of fuser roll 12, of a thermistor or other thermal sensor used to control the power to one or more lamps such as 20. FIG. 7 is a simplified diagram of one kind of temperature-sensitive mounting of a thermal sensor 40, associated with a bimetallic coil 70 and cam 72, although any equivalent arrangement could be used. As the general temperature of the fusing apparatus changes in the course of use, the position of the thermal sensor 40 changes to measure different small areas along the surface of roll 12.

In a practical application of a fusing apparatus, if sheets of a relatively small size are successively fused, the subset of the total length of the fuser roll 12 over which the small sheets pass (herein, "the small sheet fusing area") will lose heat relatively quickly, and thus have a lower temperature than the rest of the length of roll 12. An arrangement such as in FIG. 7 can be made whereby, as the general temperature of the fusing apparatus 10 changes, the temperature-sensitive mounting can move the thermal sensor in a predetermined manner toward or away from the small sheet fusing area, as needed for a particular design. For instance, in one possible arrangement, successive fusing of postcard-size sheets will create a relatively cold area along the roll 12 in the small sheet fusing area, but monitoring the local temperature in the small sheet fusing area may thus become of particular interest, and therefore the mounting of thermal sensor 40 may be configured to migrate toward the small sheet fusing area as the general temperature of the fusing apparatus 10 decreases. Other arrangements will be apparent for other specific purposes. In another scenario, for instance, the hot areas are of just as much interest as the temperature of the fuser roll can be controlled where sheets are passing over it, but areas with no sheets passing over can get too hot. Moving the lamp or the thermistor away from such an area can be of benefit.

Returning briefly to FIG. 1, it was mentioned that a fusing apparatus such as 10 can be designed to be removably mounted within a larger printing apparatus 100, so that the fusing apparatus 10 can be replaced as a module as needed. With regard to the various embodiments described herein, different configurations between a removable module and the larger apparatus can be provided. For instance, a bimetallic coil 34 or 70 or container 48 shown above, or any equivalent structure with ancillary hardware, can be provided as a permanent part of apparatus 100 or be on board the replaceable module forming fusing apparatus 10. The same idea can be applied to the temperature sensor 40 in the FIG. 7 embodiment.

In a practical application, a typical range of motion for a lamp 20 as moved by a bimetallic coil 34 is about 1 cm. Also, a lamp such as 20 will typically be provided with other support structures (not shown) to permit sliding of the lamp 20 along its axis within a roll 20. Also, a lamp such as 20 need not be disposed within a fuser roll at all, but could be provided in conjunction with some other fusing structure, such as a stationary plate or reflector.

Although the above embodiments are shown with the temperature-sensitive position changing of a single lamp 20, alternative embodiments may provide temperature-sensitive position changing of multiple lamps, mounted either together or independently. Also, although substantially perpendicular motion of the lamps or thermistors relative to the process direction is shown in the embodiments, other types of temperature-sensitive movement of the lamps or thermistors are possible, such as moving a lamp or thermistor closer or farther from the fuser roll surface according to the arrangement of the temperature-sensitive mounting.

As used herein, the term "bimetallic" shall be construed broadly to include any member or assembly having the temperature-sensitive properties associated with bimetallic strips or coils, regardless of the specific materials used in its construction.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An apparatus for fusing print sheets moving in a process direction, comprising:

a heating element;

a fuser roll, the heating element being disposed within the fuser roll;

a temperature sensor, useful in measuring a temperature of a small area of the fuser roll and thereby controlling the heating element;

a temperature-sensitive mounting for the temperature sensor, the mounting changing a position of the temperature sensor in a direction substantially perpendicular to the process direction.

2. The apparatus of claim 1, the apparatus effectively defining a small sheet fusing area, the mounting being arranged to change the position of the temperature sensor in a predetermined manner relative to the small sheet fusing area.

3. The apparatus of claim 1, wherein the heating element is disposed within a removable module installable within a printing apparatus.

4. The apparatus of claim 1, the mounting being included in the module.

5. The apparatus of claim 4, the temperature sensor being included in the module.

* * * * *